US012108844B2

(12) United States Patent
Chang

(10) Patent No.: US 12,108,844 B2
(45) Date of Patent: Oct. 8, 2024

(54) ROPE TIGHTENER

(71) Applicant: KAU SHEN INDUSTRIAL CO., LTD., Changhua (TW)

(72) Inventor: Po-Chun Chang, Changhua (TW)

(73) Assignee: KAU SHEN INDUSTRIAL CO., LTD., Changhua (TW)

( * ) Notice: Subject to any disclaimer, the term of this patent is extended or adjusted under 35 U.S.C. 154(b) by 0 days.

(21) Appl. No.: 18/323,683

(22) Filed: May 25, 2023

(65) Prior Publication Data

US 2024/0065380 A1 Feb. 29, 2024

(30) Foreign Application Priority Data

Aug. 26, 2022 (TW) ..... 111132315

(51) Int. Cl.
*A43C 11/16* (2006.01)
*A43C 7/00* (2006.01)

(52) U.S. Cl.
CPC ..... *A43C 7/00* (2013.01); *A43C 11/165* (2013.01)

(58) Field of Classification Search
CPC ..... B65H 75/442; A43C 11/00; A43C 11/008; A43C 11/16; A43C 11/65; A43C 7/00; Y10T 24/2183
See application file for complete search history.

(56) References Cited

U.S. PATENT DOCUMENTS 7,954,204 B2 * 6/2011 Hammerslag ..... A43C 11/16 36/50.5
8,235,321 B2 * 8/2012 Chen ..... A43C 11/008 242/378.1
10,368,613 B2 * 8/2019 Ha ..... A43C 7/00
2007/0084956 A1 * 4/2007 Chen ..... A43C 7/00 242/388.6
2011/0191992 A1 * 8/2011 Chen ..... A43C 11/008 24/713.2
2017/0303643 A1 * 10/2017 Converse ..... A43C 3/00

FOREIGN PATENT DOCUMENTS

| | | | |
|---|---|---|---|
| CN | 206499022 | U | 9/2017 |
| CN | 210382859 | U | 4/2020 |
| JP | 2018121890 | A | 8/2018 |
| JP | 2021008363 | A | 1/2021 |
| TW | M492646 | U | 1/2015 |

* cited by examiner

*Primary Examiner* — Robert Sandy
*Assistant Examiner* — Michael S Lee
(74) *Attorney, Agent, or Firm* — MUNCY, GEISSLER, OLDS & LOWE, P.C.

(57) ABSTRACT

A rope tightener includes a bottom seat having a bottom plate and an annular body portion, a roll-up disc having a pivot hole, and a cover having ratchet teeth and fixed to the roll-up disc. The bottom seat has an accommodating space, and a rotation axle disposed in the pivot hole. The annular body portion has at least one pawl corresponding to the ratchet teeth. The cover drives the roll-up disc to rotate or displace between pressed-down and pulled-up positions relative to the bottom seat. When the cover is located at the pressed-down position, the ratchet teeth are engaged with the pawl, enabling the cover to drive the roll-up disc to rotate about the rotation axle in a single direction. When the cover is located at the pulled-up position, the ratchet teeth are separated from the pawl, enabling the cover to drive the roll-up disc to rotate freely.

3 Claims, 8 Drawing Sheets

ROPE TIGHTENER

BACKGROUND OF THE INVENTION

1. Field of the Invention

The present invention relates to tighteners and more particularly, to a rope tightener which is simple in structure and easy in component replacement.

2. Description of the Related Art

When a user wears a shoe with a shoelace, the shoelace is usually connected with two sides of the vamp of the shoe in a cross manner, and then two end portions of the shoelace are pulled tight and knotted so that the shoelace is tightened for improving the foot fit of the shoe, enabling the user to move comfortably. However, when preschool children or senior elders need to put on and take off shoes, it is uneasy for them to do the actions of tightening and loosening shoelaces, which is really a big problem.

Secondarily, when the user works on construction sites or engages in competitive activities such as bicycle races, two end portions of the tightened shoelace are liable to loose due to intense movement or interfering with external objects, which highly increases the probability of accidents. Therefore, during the activity, the shoelace cannot loose accidentally. However, during the break, the user needs to loosen the tightened shoelace for ample rest of the foot. Therefore, we need a device capable of tightening the shoelace and capable of loosening the shoelace.

For solving the above-described problem, the conventional tighteners can satisfy the user's requirement of tightening and loosening the shoelace. However, the conventional tighteners need many components and have complicated structures, thereby uneasy in assembly, bringing the problem of lowering productivity of products. Besides, when the components are broken, it is uneasy to replace the components for maintenance, bringing the problem of low maintainability of products. From this we can see the conventional tighteners still need improvement.

SUMMARY OF THE INVENTION

The present invention has been accomplished in view of the above-noted circumstances. It is a primary objective of the present invention to provide a rope tightener which needs relatively less components, is simple in structure, and easy for replacement and maintenance when the components are broken.

To attain the above objective, the present invention provides a rope tightener which includes a bottom seat having a bottom plate and an annular body portion, a roll-up disc having a pivot hole, and a cover having a plurality of ratchet teeth and fixedly connected to the roll-up disc. The bottom seat has an accommodating space and a rotation axle. The annular body portion has at least one pawl corresponding to the ratchet teeth. The pivot hole is sleeved onto the rotation axle. The cover drives the roll-up disc to rotate relative to the bottom seat, or drives the roll-up disc to displace relative to the bottom seat between a pressed-down position and a pulled-up position. When the cover is located at the pressed-down position, the ratchet teeth are engaged with the pawl, enabling the roll-up disc to rotate about the rotation axle in a single direction. When the cover is located at the pulled-up position, the ratchet teeth are separated from the pawl, enabling the cover to drive the roll-up disc to rotate freely.

By the above-described technical feature that the roll-up disc is driven by the cover to displace relative to the bottom seat between the pressed-down position and the pulled-up position, a rope can be rolled up by the roll-up disc or the rope can be pulled out from the roll-up disc, so that the conventional tighteners' functions of tightening and loosening the shoelace can be satisfied. Besides, the rope tightener provided by the present invention only has a few components, which is simple in structure, very easy in both assembly and maintenance, thereby able to raise productivity and easiness of maintenance of products.

Preferably, the pivot hole of the roll-up disc has a lower pivot section which is circular in cross-sectional shape and rotatably sleeved onto the rotation axle, and an upper pivot section which communicates with the lower pivot section and is non-circular in cross-sectional shape; the cover has a main driving shaft protruding downwardly; the main driving shaft is complementary in shape to the upper pivot section, and the main driving shaft is embedded in the upper pivot section, enabling the cover to drive the roll-up disc to rotate relative to the bottom seat and drive the roll-up disc to displace relative to the bottom seat between the pressed-down position and the pulled-up position. Therefore, by the lower pivot section of the pivot hole being sleeved onto the rotation axle and the main driving shaft being embedded in the upper pivot section of the pivot hole, the cover can drive the roll-up disc to slide upwardly and downwardly and rotate relative to the rotation axle of the bottom seat.

Preferably, the main driving shaft of the cover is provided with a counterbore; the rope tightener further includes a first fastening screw; the first fastening screw has a head portion and a threaded body portion connected with the head portion; the first fastening screw is inserted through the counterbore of the main driving shaft to be screwed into the rotation axle, and the head portion of the first fastening screw is located in the counterbore; when the cover is located at the pulled-up position, the head portion of the first fastening screw is abutted on a bottom surface of the counterbore. Therefore, the head portion of the first fastening screw limits the highest position of the pulled-up cover.

Preferably, the rope tightener further includes a second fastening screw which is screwed between the cover and the roll-up disc to fasten the cover and the roll-up disc to each other.

Preferably, the roll-up disc has a fixedly connecting hole; the cover has an auxiliary driving shaft protruding downwardly and disposed separately from the main driving shaft; the auxiliary driving shaft is embedded in the fixedly connecting hole; the second fastening screw has a head portion and a threaded body portion connected with the head portion; the threaded body portion of the second fastening screw is inserted through the fixedly connecting hole and screwed into the auxiliary driving shaft of the cover, and the head portion of the second fastening screw is abutted against the roll-up disc. Therefore, by the auxiliary driving shaft being embedded in the fixedly connecting hole, the second fastening screw can fasten the cover and the roll-up disc to each other more tightly.

Preferably, an outer peripheral surface of the rotation axle of the bottom seat has a first annular groove and a second annular groove; an inner wall of the pivot hole of the roll-up disc has an annular wedged portion; when the cover is located at the pressed-down position, the annular wedged portion is wedged in the first annular groove; when the cover is located at the pulled-up position, the annular wedged portion is wedged in the second annular groove. Therefore, when the cover is located at the pressed-down position or the pulled-up position, the annular wedged portion is wedged in the first annular groove or the second annular groove, which can limit the roll-up disc to be relatively wedged at a fixed position of the rotation axle without sliding.

Preferably, the annular body portion of the bottom seat has a first through hole, and a second through hole corresponding to the first through hole; the at least one pawl includes a first pawl, and a second pawl corresponding to the first pawl; the first and second pawls and the first and second through holes are provided on the annular body portion at equal intervals to surround the rotation axle. Therefore, when the ratchet teeth of the cover are engaged with the first and second pawls of the bottom seat, the cover can drive the roll-up disc to stably rotate about the rotation axle in a single direction.

Preferably, the roll-up disc has a bottom plate, a top plate, and a middle portion connected between the top and bottom plates; the pivot hole penetrates through the bottom plate, the top plate and the middle portion.

Preferably, the roll-up disc has a bottom plate; the bottom plate includes a first bottom portion, a second bottom portion disposed separately from the first bottom portion, and a connecting portion connected between the first and second bottom portions; the rope tightener further includes an elastic member; the elastic member has two elastic abutted portions; the elastic abutted portions of the elastic member are abutted against two sides of the connecting portion of the roll-up disc respectively; an outer peripheral surface of the rotation axle of the bottom seat has a first annular groove and a second annular groove; when the cover is located at the pressed-down position, the elastic abutted portions of the elastic member are wedged in the first annular groove of the rotation axle; when the cover is located at the pulled-up position, the elastic abutted portions of the elastic member are wedged in the second annular groove of the rotation axle. In this way, when the cover is located at the pressed-down position or the pulled-up position, a noise is made by the elastic abutted portions being wedged into the first annular groove or the second annular groove, thereby reminding the user that the roll-up disc is relatively wedged at a fixed position of the rotation axle.

Preferably, the roll-up disc further has an accommodating groove; the accommodating groove is located between the first and second bottom portions and the connecting portion; the elastic member further has an arc-shaped body portion located between the elastic abutted portions; the arc-shaped body portion of the elastic member is accommodated in the accommodating groove of the roll-up disc so that the elastic member and the roll-up disc are driven by the cover together to slide upwardly and downwardly relative to the rotation axle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The rope tightener of the present invention will be further described in the following embodiments and the accompanying drawings, and wherein.

DETAILED DESCRIPTION OF THE INVENTION

First of all, it is to be mentioned that the technical features provided by the present invention are unlimited to the specific structure, usage and application thereof described in the detailed description of the invention. It should be understood by those skilled in the related art that all the terms used in the contents of the specification are for illustrative description. The directional terms mentioned in this specification, such as 'front, upper, lower, rear, left, right, top, bottom, in, and out', are also just for illustrative description on the basis of normal usage direction, not intended to limit the claimed scope.

Figure 1:
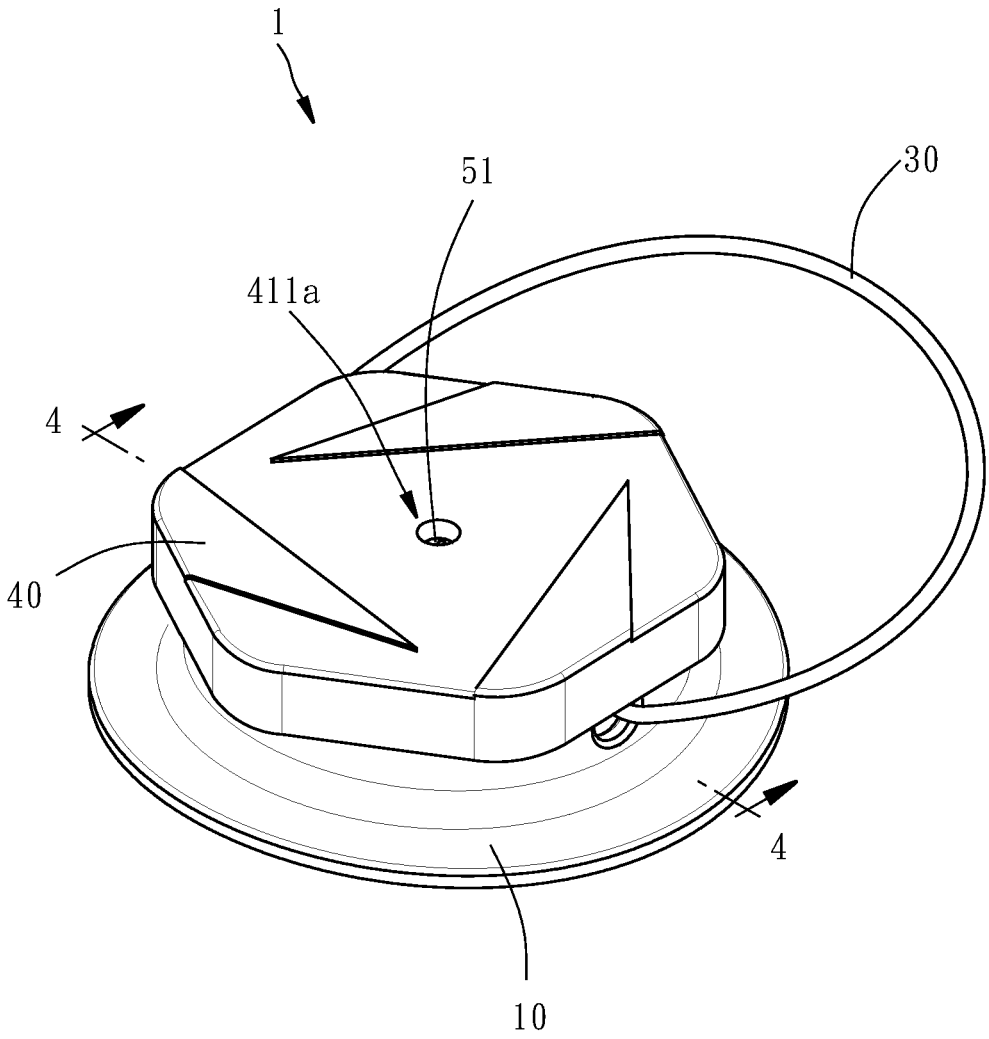
FIG. 1 is an assembled perspective view of a rope tightener according to a first embodiment of the present invention.
Figure 2:
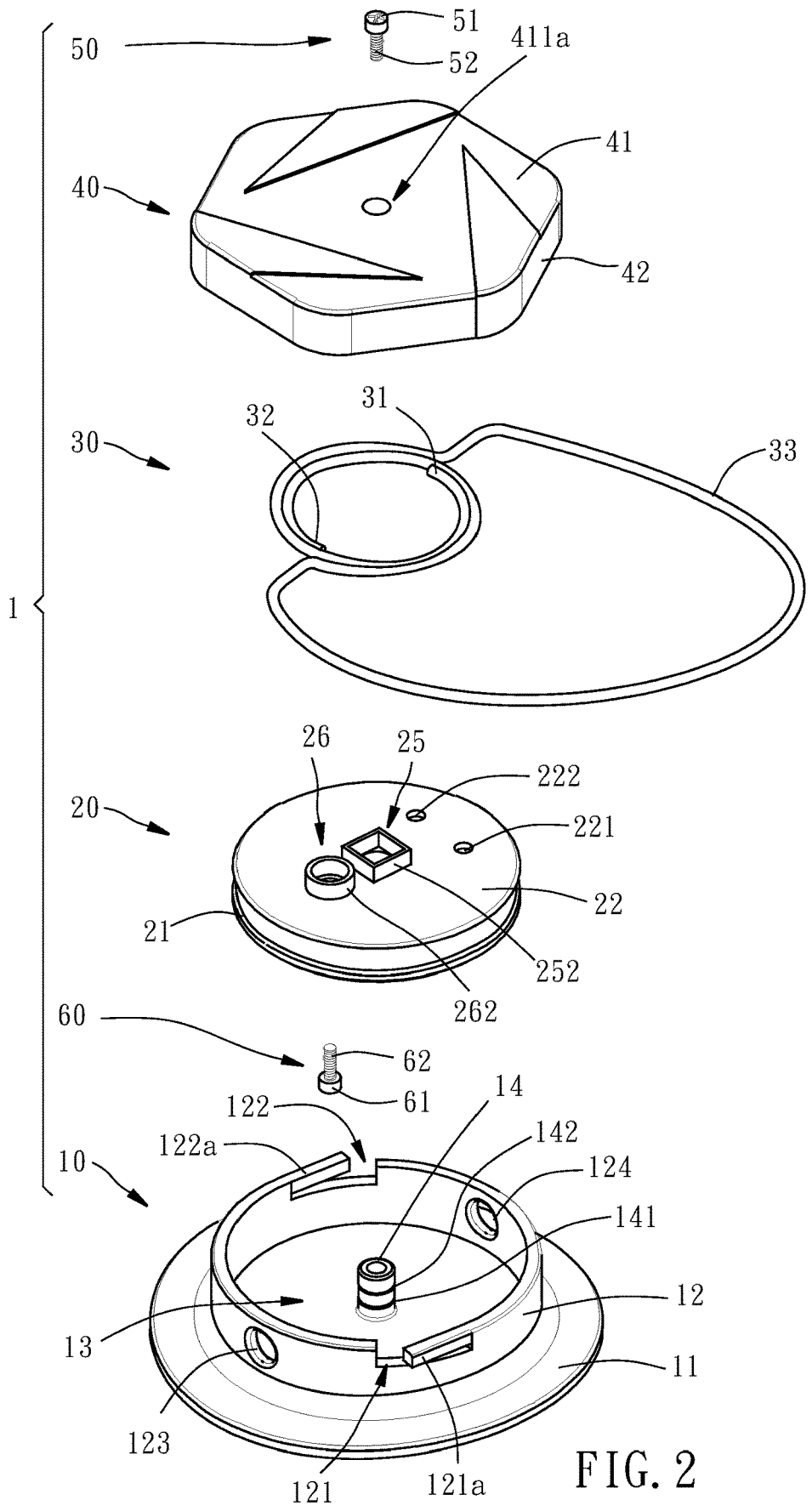
FIG. 2 is an exploded perspective view of the first embodiment shown in FIG. 1.
Figure 3:
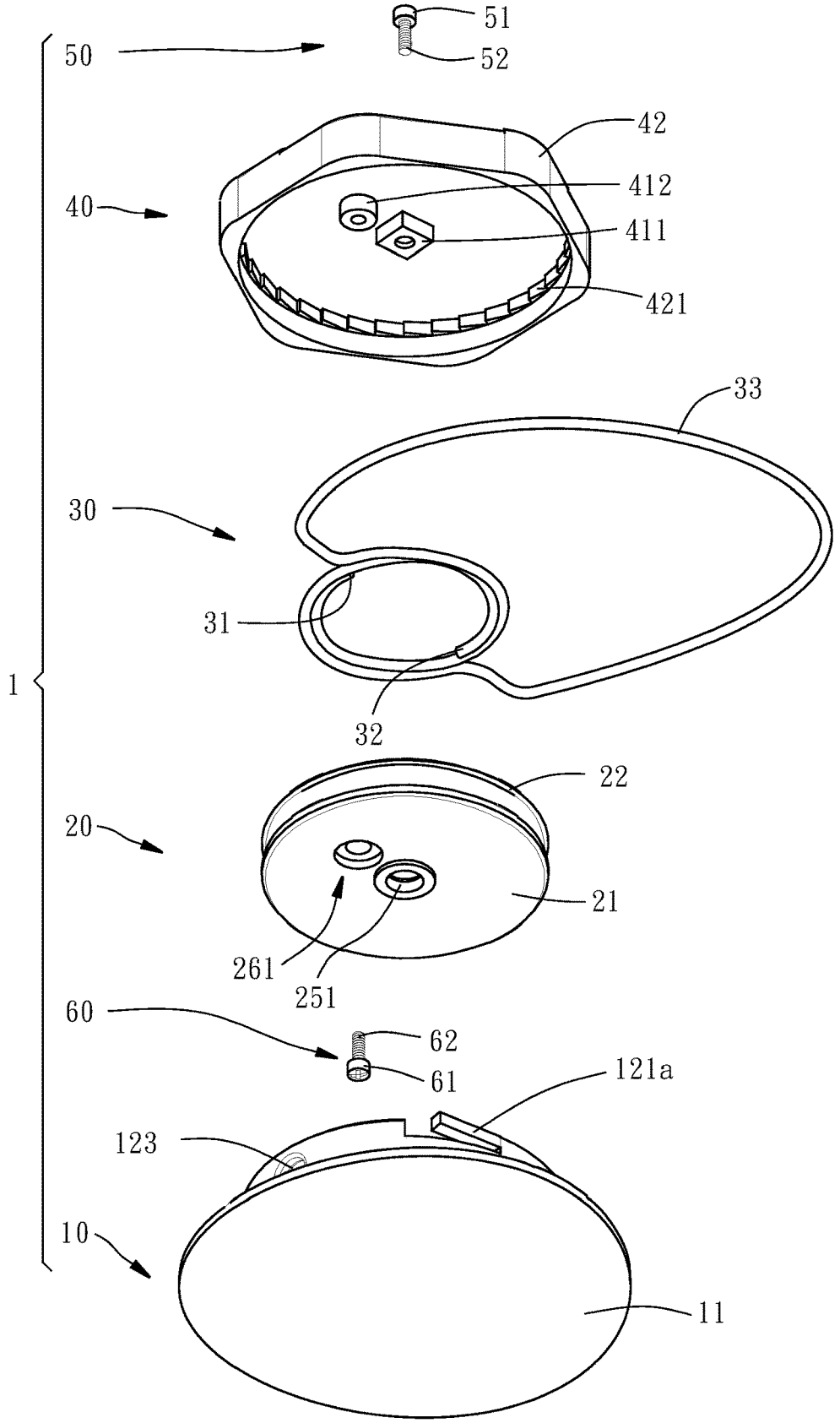
FIG. 3 is an exploded perspective view of the first embodiment shown in FIG. 1 from another visual angle.

Referring to FIG. 1 to FIG. 3, a rope tightener 1 according to a first embodiment of the present invention primarily includes a bottom seat 10, a roll-up disc 20, a cover 40, a first fastening screw 50, and a second fastening screw 60. The structural features of each component will be described hereinafter.

The bottom seat 10 is a component integrally formed by molding, having a bottom plate 11, an annular body portion 12 extending upwardly from the bottom plate 11, an accommodating space 13 surrounded and confined by the bottom plate 11 and the annular body portion 12, and a rotation axle 14 extending upwardly from the bottom plate 11 and located in the accommodating space 13. Specifically speaking, in this embodiment, an outer peripheral surface of the rotation axle 14 has a first annular groove 141 and a second annular groove 142, and an outer peripheral surface of the annular body portion 12 has a first breach 121 and a second breach 122 corresponding to the first breach 121. Secondarily, the outer peripheral surface of the annular body portion 12 has a first pawl 121*a* connected with a right side of the first breach 121 and protruding toward the outside of the first breach 121. Likewise, the outer peripheral surface of the annular body portion 12 has a second pawl 122*a* connected with a left side of the second breach 122 and protruding toward the outside of the second breach 122. Besides, the annular body portion 12 has a first through hole 123 and a second through hole 124 corresponding to the first through hole 123. The first and second pawls 121*a* and 122*a* and the first and second through holes 123 and 124 are provided on the annular body portion 12 at equal intervals to surround the rotation axle 14.

Referring to FIG. 2, FIG. 3, FIG. 4*a* and FIG. 4*b*, the roll-up disc 20 is a component integrally formed by molding, which includes a bottom plate 21, a top plate 22, and a middle portion 23 connected between the top and bottom plates 21 and 22. Besides, a roll-up groove 24 is formed between the bottom plate 21, the top plate 22 and the middle portion 23. Specifically speaking, the top plate 22 has a pair of through holes 221 and 222, the roll-up disc 20 has a pivot hole 25 and a fixedly connecting hole 26, and the pivot hole 25 and the fixedly connecting hole 26 both penetrate through the bottom plate 21, the top plate 22 and the middle portion 23. Secondarily, the pivot hole 25 has a lower pivot section 251 which is circular in cross-sectional shape, and an upper pivot section 252 which is square in cross-sectional shape and communicates with the lower pivot section 251. An inner wall of the lower pivot section 251 has an annular wedged portion 251*a*. The upper pivot section 252 extends upwardly from the top plate 22. In addition, the fixedly connecting hole 26 has a counterbore 261 recessed from the bottom plate 21, and a fixedly connecting section 262 extending upwardly from the top plate 22.

The cover 40 is a component integrally formed by molding, which includes a top plate 41 and an annular side wall 42 extending downwardly from the top plate 41. Specifically speaking, the cover 40 has a main driving shaft 411 protruding downwardly from the top plate 41, and an auxiliary driving shaft 412 protruding downwardly from the top plate 41 and disposed separately from the main driving shaft 411. Secondarily, the main driving shaft 411 has a counterbore 411*a* downwardly penetrating therethrough from the top plate 41. An inner wall surface of the annular side wall 42 has a plurality of ratchet teeth 421 distributed annularly, and the ratchet teeth 421 correspond to the first and second pawls 121*a* and 122*a* of the bottom seat 10.

The structural features of the components of the rope tightener 1 according to the first embodiment of the present invention are described above. The assembly and usage manner of the rope tightener 1 will be further introduced hereinafter.

Referring to FIG. 2, FIG. 3, FIG. 4*a* and FIG. 4*b*, in practice, the rope tightener 1 of the present invention is applied in coordination with a rope 30, such as a metal wire but unlimited thereto. The rope 30 includes a first end portion 31, a second end portion 32, and a body portion 33 located between the first end portion 31 and the second end portion 32.

In this embodiment, the roll-up disc 20 is disposed in the accommodating space 13 of the bottom seat 10. Specifically speaking, at first the lower pivot section 251 of the pivot hole 25 of the roll-up disc 20 is sleeved onto the rotation axle 14 of the bottom seat 10. Then, the first and second end portions 31 and 32 of the rope 30 are respectively inserted through the first and second through holes 123 and 124 of the annular body portion 12 of the bottom seat 10 and then inserted through the through holes 221 and 222 of the top plate 22 of the roll-up disc 20, and the first and second end portions 31 and 32 are tied to be fixed to the top plate 22 of the roll-up disc 20. In this way, the body portion 33 of the rope 30 is inserted through the first and second through holes 123 and 124 of the annular body portion 12 of the bottom seat 10, so that a part of the body portion 33 of the rope 30 is exposed out of the bottom seat 10 and the rest part of the body portion 33 of the rope 30 not exposed out of the bottom seat 10 can be rolled up and accommodated in the roll-up groove 24 of the roll-up disc 20. However, the fixing between the first and second end portions 31 and 32 and the through holes 221 and 222 is unlimited to the tied manner, but may be achieved by gluing, buttoning or other suitable manners.

After the roll-up disc 20 is placed in the accommodating space 13 of the bottom seat 10, the cover 40 and the roll-up disc 20 are fixed to each other. Specifically speaking, the main driving shaft 411 of the cover 40 is complementary in shape to the upper pivot section 252 of the pivot hole 25, so the main driving shaft 411 is embedded in the upper pivot section 252. The auxiliary driving shaft 412 of the cover 40 is complementary in shape to the fixedly connecting section 262 of the fixedly connecting hole 26, so the auxiliary driving shaft 412 is embedded in the fixedly connecting section 262. Therefore, the roll-up disc 20 and the cover 40 can be temporarily fixed to each other.

It can be known from the above description that until now the bottom seat 10, the roll-up disc 20, the rope 30 and the cover 40 are already temporarily fixed to each other. Then, the bottom seat 10, the roll-up disc 20 and the cover 40 are fastened to each other by the first fastening screw 50 and the second fastening screw 60. Specifically speaking, the first fastening screw 50 has a head portion 51 and a threaded body portion 52 connected with the head portion 51. The second fastening screw 60 has a head portion 61 and a threaded body portion 62 connected with the head portion 61. The threaded body portion 52 of the first fastening screw 50 is inserted through the counterbore 411*a* of the cover 40 and screwed into the rotation axle 14 of the bottom seat 10, and the head portion 51 of the first fastening screw 50 is located in the counterbore 411*a* of the cover 40. The threaded body portion 62 of the second fastening screw 60 is inserted through the fixedly connecting hole 26 of the roll-up disc 20 and screwed into the auxiliary driving shaft 412 of the cover 40, and the head portion 61 of the second fastening screw 60 is abutted on a bottom surface of the counterbore 261 of the fixedly connecting hole 26. The bottom seat 10, the roll-up disc 20 and the cover 40 can be fastened coaxially by the first fastening screw 50. The cover 40 and the roll-up disc 20 can be tightly fastened to each other by the second fastening screw 60.

Figure 4A:
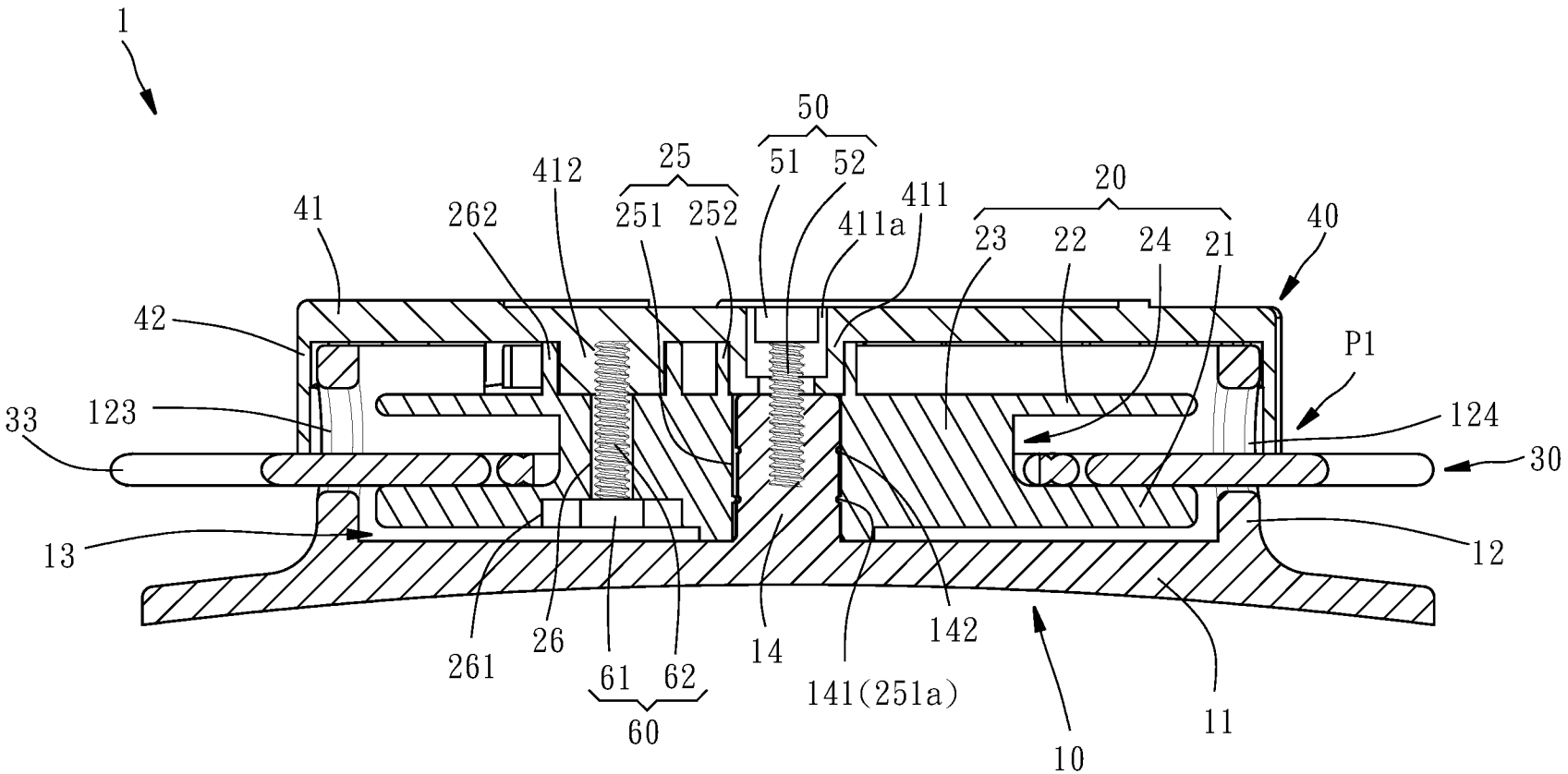
FIG. 4*a* is a sectional view taken along the line 4-4 in FIG. 1, showing a cover is located at a pressed-down position.
Figure 4B:
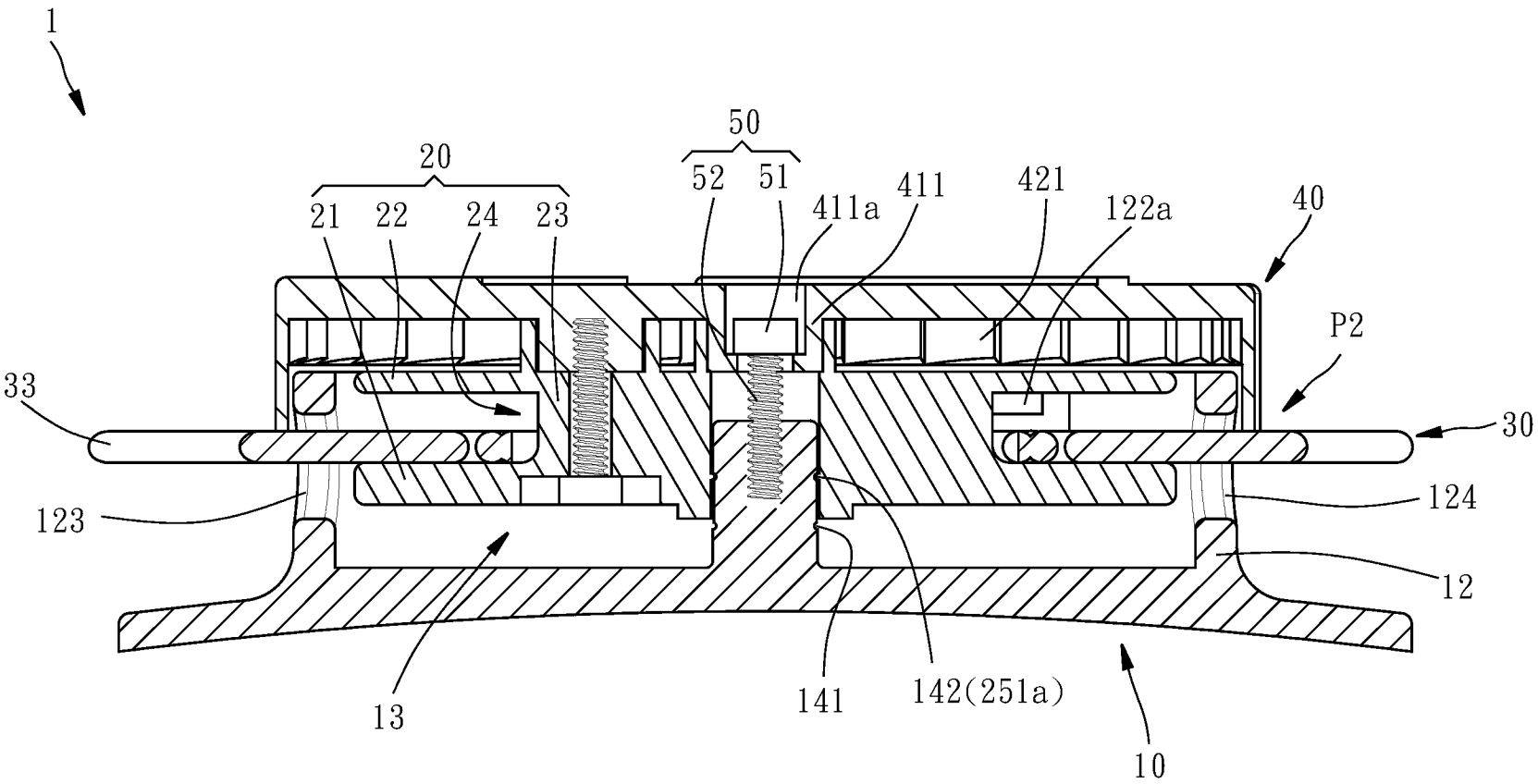
FIG. 4*b* is similar to FIG. 4*a*, but showing the cover is located at a pulled-up position.

After the assembly of the rope tightener 1 is accomplished, the roll-up disc 20 is disposed in the accommodating space 13 of the bottom seat 10. The cover 40 can drive the roll-up disc 20 to rotate relative to the rotation axle 14 of the bottom seat 10, and the cover 40 can drive the roll-up disc 20 to displace relative to the bottom seat 10 between a pressed-down position P1 as shown in FIG. 4*a* and a pulled-up position P2 as shown in FIG. 4*b*. Specifically speaking, when the user presses the cover 40 down to make the cover 40 located at the pressed-down position P1 as shown in FIG. 4*a*, the ratchet teeth 421 of the cover 40 are engaged with the first and second pawls 121*a* and 122*a* of the bottom seat 10. By the coordination of the ratchet teeth 421 and the first and second pawls 121*a* and 122*a*, the cover 40 drives the roll-up disc 20 to rotate about the rotation axle 14 in a single direction. Secondarily, the roll-up disc 20 is driven by the cover 40 to displace downwardly, making the annular wedged portion 251*a* of the roll-up disc 20 wedged in the first annular groove 141 of the rotation axle 14. Therefore, the user can rotate the cover 40 to drive the roll-up disc 20 to rotate in the direction for rolling up the rope 30 in the roll-up groove 24 of the roll-up disc 20. Besides, the arrangement of the ratchet teeth 421 and the first and second pawls 121*a* and 122*a* disables the cover 40 and the roll-up disc 20 from being rotated reversely, so the rope 30 can be maintained at the status of being rolled up in the roll-up groove 24 and cannot be pulled out from the roll-up groove 24. In other words, in the condition that the rope tightener 1 provided by this invention is applied to a shoe, when the user presses the cover 40 down to make the cover 40 located at the pressed-down position P1, the user can tighten the shoelace (the rope 30 mentioned in this embodiment) by rotating the cover 40, and the shoelace is ensured to be maintained at the tightened status and will not loose. It is to be mentioned that when the cover 40 is located at the pressed-down position P1, the first and second through holes 123 and 124 of the annular body portion 12 of the bottom seat 10 are not completely covered by the annular side wall 42 of the cover 40, so that the body portion 33 of the rope 30 inserted through the first and second through holes 123 and 124 and exposed out of the bottom seat 10 can be still rolled up and accommodated in the roll-up groove 24 of the roll-up disc 20.

On the other hand, when the cover is located at the pulled-up position P2 as shown in FIG. 4*b*, the ratchet teeth 421 of the cover 40 are separated from the first and second pawls 121*a* and 122*a* of the bottom seat 10 (only the second pawl 122*a* is shown in the figure), and at this time the head portion 51 of the first fastening screw 50 is abutted on a bottom surface of the counterbore 411*a* of the main driving shaft 411, limiting the pulled-up position of the cover 40. Meanwhile, the roll-up disc 20 is driven by the cover to displace upwardly, making the annular wedged portion 251*a* of the roll-up disc 20 wedged in the second annular groove 142 of the rotation axle 14 and thereby positioned. In this way, the ratchet teeth 421 have been separated from the first and second pawls 121*a* and 122*a*, enabling the cover 40 to drive the roll-up disc 20 to rotate freely, so the body portion 33 of the rope 30 can be pulled out from the roll-up groove 24 of the roll-up disc 20. In other words, if the rope tightener 1 provided by this invention is applied to a shoe, at this time the user can loosen the shoelace.

Figure 6A:
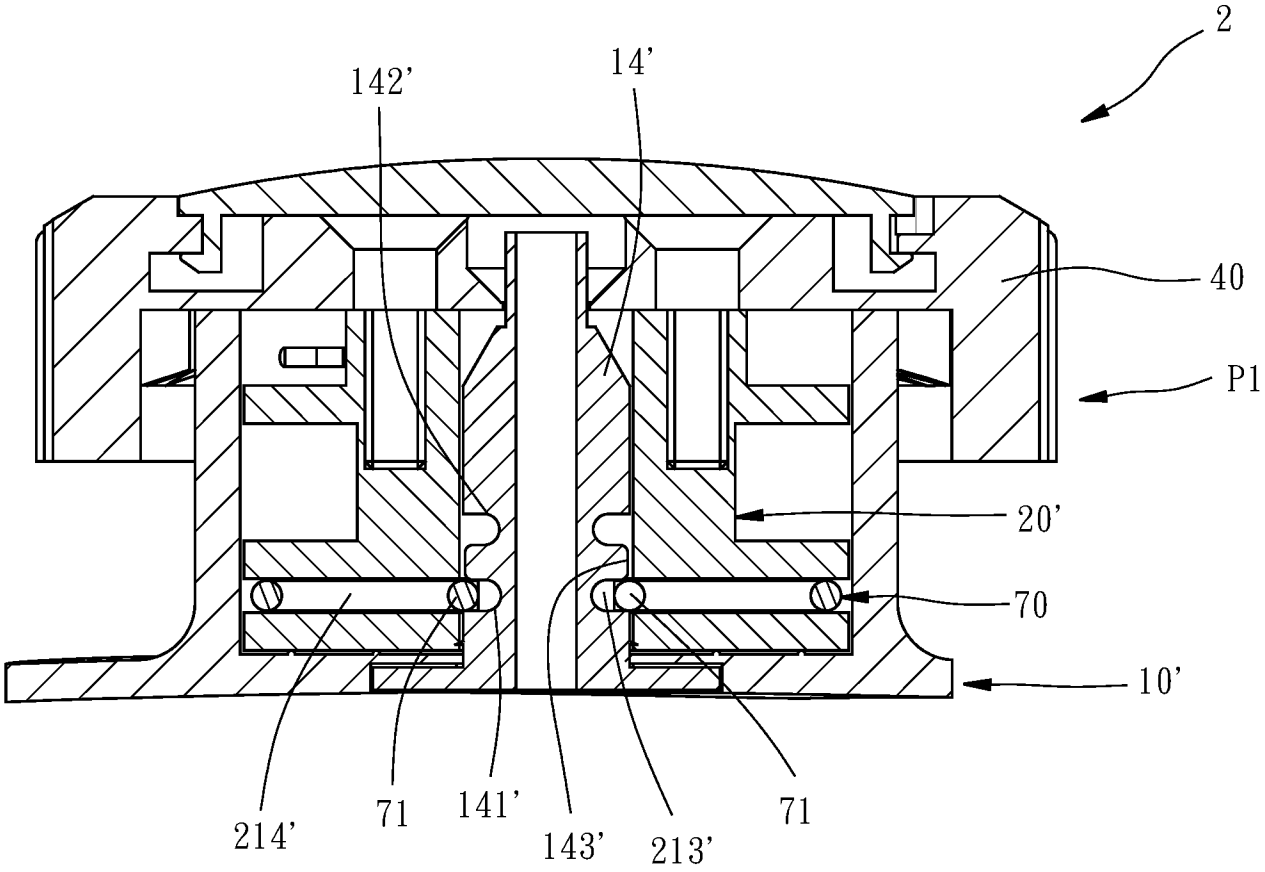
FIG. 6*a* is a sectional view of the rope tightener according to the second embodiment of the present invention, showing a cover is located at a pressed-down position.

However, the rope tightener 1 of the present invention is unlimited to that disclosed in this embodiment. A rope tightener 2 of a second embodiment of the present invention is approximately the same in structure with the first embodiment, but the difference therebetween is that the structure of the bottom seat 10' is different. As shown in FIG. 6*a*, the bottom seat 10' has a rotation axle 14'. The outer peripheral surface of the rotation axle 14' has a first annular groove 141', a second annular groove 142' and a pushing portion 143' located between the first and second annular grooves 141' and 142', and the first and second annular grooves 141' and 142' are relatively deeper in depth.

Figure 5:
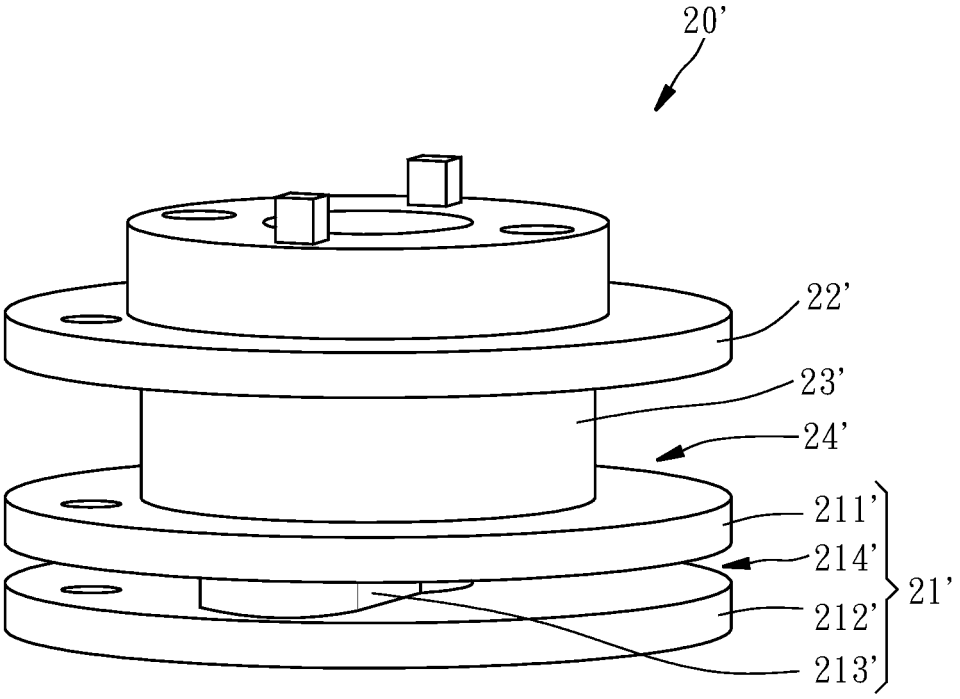
FIG. 5 is a perspective view of a roll-up disc and an elastic member of a rope tightener according to a second embodiment of the present invention.
Figure 5:
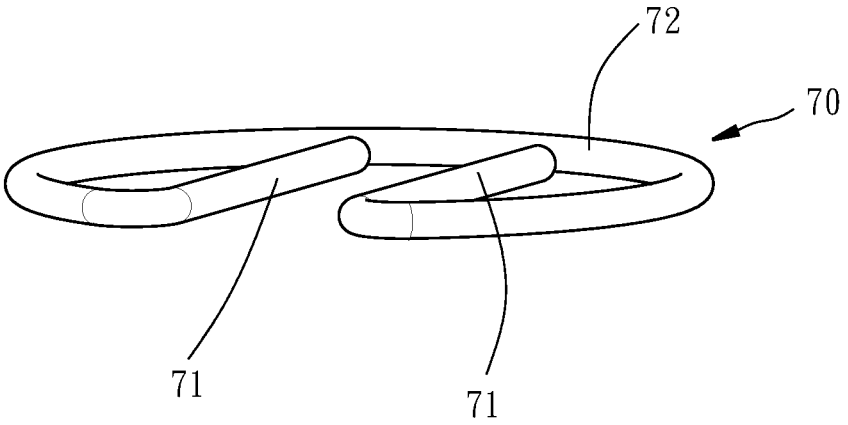

The rope tightener 2 is approximately the same in structure with the first embodiment, but the difference therebetween is that the structure of the roll-up disc 20' is different. As shown in FIG. 5, the roll-up disc 20' has a bottom plate 21' and a top plate 22'. The bottom plate 21' has a first bottom portion 211', a second bottom portion 212' disposed separately from the first bottom portion 211', a connecting portion 213' connected between the first and second bottom portions 211' and 212', and an accommodating groove 214' located between the first and second bottom portions 211' and 212' and the connecting portion 213'. The roll-up disc 20' further has a middle portion 23' connected between the top plate 22' and the first bottom portion 211', a roll-up groove 24' located between the top plate 22', the first bottom portion 211' and the middle portion 23'. The rope 30 (as shown in FIG. 3) is fixed to the roll-up groove 24' of the roll-up disc 20' in the same manner with that in the first embodiment, therefore that is not repeatedly described here.

In this embodiment, the rope tightener 2 further includes an elastic member 70. The elastic member 70 has two elastic abutted portions 71 and an arc-shaped body portion 72 located between the elastic abutted portions 71. In practical assembly, the elastic abutted portions 71 of the elastic member 70 are abutted against two sides of the connecting portion 213' of the roll-up disc 20' respectively, as shown in FIG. 6*a*, and the arc-shaped body portion 72 of the elastic member 70 is accommodated in the accommodating groove 214' of the roll-up disc 20'.

Further speaking, when the user presses the cover 40 down to make the elastic member 70 and the roll-up disc 20' driven by the cover 40 together to move downwardly relative to the rotation axle 14', the elastic abutted portions 71 of the elastic member 70 are pushed by the pushing portion 143' of the rotation axle 14' and thereby store an elastic restoring force. When the cover 40 is located at the pressed-down position P1 as shown in FIG. 6*a*, the elastic abutted portions 71 are no longer pushed by the pushing portion 143' of the rotation axle 14' and thereby release the elastic restoring force, making the elastic abutted portions 71 wedged in the first annular groove 141' of the rotation axle 14' and thereby positioned. Besides, when the elastic abutted portions 71 are wedged into the first annular groove 141' of the rotation axle 14', a noise is made and thereby reminds the user that the roll-up disc 20' is relatively wedged at a fixed position of the rotation axle 14'. In addition, when the cover 40 is located at the pressed-down position P1, the operating manner of the cover 40 driving the roll-up disc 20' to roll up the rope 30 is the same with that in the first embodiment, thereby not repeatedly described here.

Figure 6B:
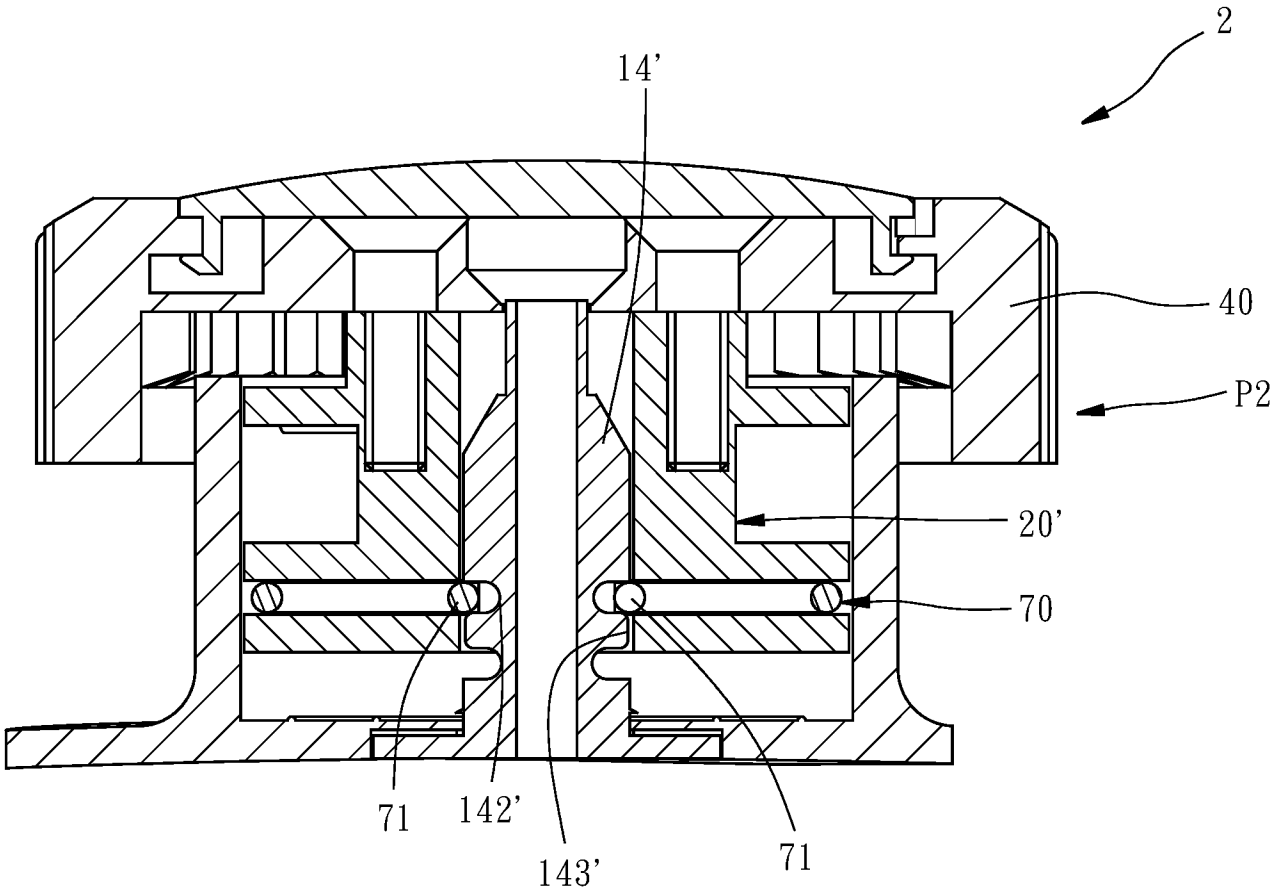
FIG. 6*b* is similar to FIG. 6*a*, but showing the cover is located at a pulled-up position.

On the other hand, in the process that the cover 40 is moved from the pressed-down position P1 as shown in FIG. 6*a* to the pulled-up position P2 as shown in FIG. 6*b*, the elastic member 70 and the roll-up disc 20' are driven by the cover 40 together to move upwardly relative to the rotation axle 14'. At this time, the elastic abutted portions 71 of the elastic member 70 are pushed by the pushing portion 143' of the rotation axle 14' and thereby store an elastic restoring force. When the cover 40 is moved to the pulled-up position P2 as shown in FIG. 6*b*, the elastic abutted portions 71 are no longer pushed by the pushing portion 143' of the rotation axle 14' and thereby release the elastic restoring force, making the elastic abutted portions 71 wedged in the second annular groove 142' of the rotation axle 14' and thereby positioned. Besides, when the elastic abutted portions 71 are wedged into the second annular groove 142' of the rotation axle 14', a noise is made and thereby reminds the user that the roll-up disc 20' is relatively wedged at another fixed position of the rotation axle 14'. In addition, when the cover 40 is located at the pulled-up position P2, the operating manner of the cover 40 driving the roll-up disc 20' to make the rope 30 pulled out from the roll-up disc 20' is the same with that in the first embodiment, thereby not repeatedly described here.

In conclusion, as to the rope tightener 1 or 2 provided by the present invention, the roll-up disc 20 or the roll-up disc 20' is driven by the cover 40 to displace to the pressed-down position P1, making the roll-up disc 20 rotate about the rotation axle 14 in a single direction or making the roll-up disc 20' rotate about the rotation axle 14' in a single direction, so that the body portion 33 of the rope 30 can be rolled up in the roll-up groove 24 of the roll-up disc 20 or the body portion 33 of the rope 30 can be rolled up in the roll-up groove 24' of the roll-up disc 20', and thereby the function of tightening the rope 30 is achieved. In addition, as to the rope tightener 1 or 2 provided by the present invention, the roll-up disc 20 or the roll-up disc 20' can be driven by the cover 40 to displace to the pulled-up position P2 to enable the body portion 33 of the rope 30 to be pulled out from the roll-up groove 24 of the roll-up disc 20 or enable the body portion 33 of the rope 30 to be pulled out from the roll-up groove 24' of the roll-up disc 20', and thereby the function of loosening the rope 30 is achieved, so that the objective of the present invention is attained. Besides, the rope tightener 1 or 2 provided by the present invention only has a few components, which is simple in structure, very easy in both assembly and maintenance, thereby able to raise productivity and easiness of maintenance of products. In addition, the rope tightener 1 or 2 is unlimited to the usage for shoelace of shoe products, but may be applied to other objects requiring repeated tightening and loosening by the rope 30.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rope tightener comprising:

a bottom seat having a bottom plate, an annular body portion extending upwardly from the bottom plate, an accommodating space formed by the bottom plate and the annular body portion, and a rotation axle extending upwardly from the bottom plate and located in the accommodating space, the annular body portion having at least one pawl;

a roll-up disc having a pivot hole, the pivot hole being sleeved onto the rotation axle to make the roll-up disc rotatably disposed in the accommodating space and slidable upwardly and downwardly along the rotation axle; and a cover fixedly connected to the roll-up disc, thereby capable of driving the roll-up disc to rotate, the cover having a plurality of ratchet teeth, the ratchet teeth and said at least one pawl corresponding to each other, the cover being able to drive the roll-up disc to displace relative to the bottom seat between a pressed-down position and a pulled-up position, when the cover is located at the pressed-down position, the ratchet teeth being engaged with said at least one pawl, enabling the cover to drive the roll-up disc to rotate about the rotation axle in a single direction, when the cover is located at the pulled-up position, the ratchet teeth being separated from said at least one pawl, enabling the cover to drive the roll-up disc to rotate freely; and an elastic member mounted to the roll-up disc and provided with two elastic abutted portions;

wherein an outer peripheral surface of the rotation axle of the bottom seat has a first annular groove and a second annular groove; when the cover is located at the pressed-down position, the elastic abutted portions of the elastic member are wedged in the first annular groove of the rotation axle; when the cover is located at the pulled-up position, the elastic abutted portions of the elastic member are wedged in the second annular groove of the rotation axle.

2. The rope tightener as claimed in claim 1, wherein the roll-up disc has a bottom plate; the bottom plate comprises a first bottom portion, a second bottom portion disposed separately from the first bottom portion, and a connecting portion connected between the first and second bottom portions; the elastic abutted portions of the elastic member are abutted against two sides of the connecting portion of the roll-up disc respectively.

3. The rope tightener as claimed in claim 2, wherein the roll-up disc further has an accommodating groove; the accommodating groove is located between the first and second bottom portions and the connecting portion; the elastic member further has an arc-shaped body portion located between the elastic abutted portions; the arc-shaped body portion of the elastic member is accommodated in the accommodating groove of the roll-up disc so that the elastic member and the roll-up disc are driven by the cover together to slide upwardly and downwardly relative to the rotation axle.

* * * * *